United States Patent [19]

Romagnoli

[11] 4,415,597

[45] Nov. 15, 1983

[54] FILTER-BAG FOR INFUSION PRODUCTS

[75] Inventor: Andrea Romagnoli, S. Lassare di Savena, Italy

[73] Assignee: Ima-Industria Macchine Automatiche-S.p.A., Emilia, Italy

[21] Appl. No.: 199,682

[22] Filed: Oct. 22, 1980

Related U.S. Application Data

[63] Continuation of Ser. No. 95,544, Nov. 19, 1979, abandoned, which is a continuation-in-part of Ser. No. 685,031, May 10, 1976, abandoned.

[51] Int. Cl.[3] ..... B65B 29/04

[52] U.S. Cl. ..... 426/394; 426/83

[58] Field of Search ..... 210/282; 426/77–84, 426/394

[56] References Cited

U.S. PATENT DOCUMENTS 2,359,271 9/1944 Sidebotham ..... 426/394
2,364,903 12/1944 Howard ..... 426/84
2,954,294 9/1960 Whelan ..... 426/83

FOREIGN PATENT DOCUMENTS 704669 3/1965 Canada .
823348 11/1959 United Kingdom .
924529 4/1963 United Kingdom .

*Primary Examiner*—Ivars C. Cintins
*Attorney, Agent, or Firm*—Karl F. Ross; Herbert Dubno

[57] ABSTRACT

A filter-bag for infusion products, such as tea, camomile, or the like, formed of a blank of filter paper tape coated with a heat-sealable layer of thermoplastic material, longitudinally folded into two halves so that said layer remains in the inside and heat-sealed so as to define an infusion product containing space. A tag is attached by a thread of natural fibers retained at one end thereof between two heat-sealed edges of the bag and wound around the latter.

The thread is fixed on the outside of the bag by means of heat-sealing at several points.

1 Claim, 2 Drawing Figures

FILTER-BAG FOR INFUSION PRODUCTS

This is a continuation of application Ser. No. 95,544, filed Nov. 19, 1979, now abandoned which is a continuation of Ser. No. 685,031, filed 5-10-76, abandoned.

FIELD OF THE INVENTION

This invention relates to a filter-bag for infusion products.

BACKGROUND OF THE INVENTION

It is known that in the handling of the filter-bag, after the same has been formed, it is important that the tag and its cotton thread are closely and firmly fitted on or adhered to the bag.

At present this is done by winding the thread around the bag and connecting it to the tag which is secured at one end of the bag. The fixing of the thread on the tag and on the bag is carried out by means of clips.

Another technique has been applied in bags formed from heat-sealable tapes. It is known that such tapes have on one face thereof a layer of heat-sealable thermoplastic material, which is partly diffused or spread into the interior of a web of filter paper. During the formation of the bags the tape is longitudinally folded into two halves so that the layer of thermoplastic material is arranged at the inside thereby allowing heat-sealing along the peripheral edges of the bag. In this type of bag the thread is replaced by a strip of heat-sealable thermoplastic material, which has one end thereof sealed between the peripheral heat-sealed edges of the bag and is sealed to the outside surface of the bag, at selected small areas.

It has been found that bags of this type, while being suitable for high productivity, have som essential drawbacks. First of all the cost of the strip affects in a remarkable manner the final confection, since such cost is remarkably greater than the cost of the conventional thread of natural fibers. Furthermore, definitely, the heat-sealable thermoplastic strip has the property to transfer to the infusion a strange disagreeable taste. Moreover the detachment between the strip and the bags is not always perfect and may cause the tearing of the bag walls and escape of product from the bag.

SUMMARY OF THE INVENTION

An object of this invention is to provide a filter-bag for infusions in which the above drawbacks are removed. According to the invention this object is attained by a filter-bag for infusion products, such as tea, camomile, or the like, comprising a blank of filter paper coated with a heat sealable layer of thermoplastic material, said blank being folded along a medial line to form two half sections having the coating layers of thermoplastic material facing together and heat sealed along the edges of said sections so as to define a closed containing space for the infusion product, said bag further comprising a thread of natural fibers wound around the bag and having one end retained between the heat sealed edges of said sections and a tag fixed at the other end, said thread being detachably heat sealed at several points on the bag wherein according to the improvement each seal point is formed by localized impregnation of the thread with the thermoplastic material of the coating layer diffused through the filter paper during heat sealing.

It has been surprisingly found that, by effecting the heat-sealing of a thread of natural fibers, e.g. cotton, on the outer paper blank, the thread remains attached to satisfactory degree without unwinding the subsequent confectioning operations. This surprising effect can probably be ascribed to the fact that, during the heat-sealing, the thermoplastic material forming the inner coating layer diffuses through the paper layer melts and until it reaches the thread, thereby partially impregnating and consequently retaining the same. In this way the integrity of the taste of the infusion is safeguarded, owing to the neutral character of the cotton thread, while at the same time it is possible to increase the operative speed of the confectioning or packaging apparatus.

BRIEF DESCRIPTION OF THE DRAWING

Further details of the invention, appear more clearly from the following description of an embodiment thereof illustrated in the accompanying drawing in which.

SPECIFIC DESCRIPTION

Figure 2:
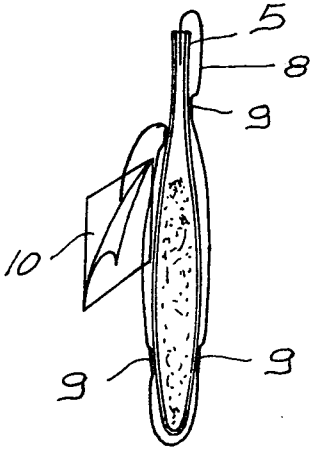
FIG. 2 shows a sectional view of the bag of FIG. 1.
Figure 1:
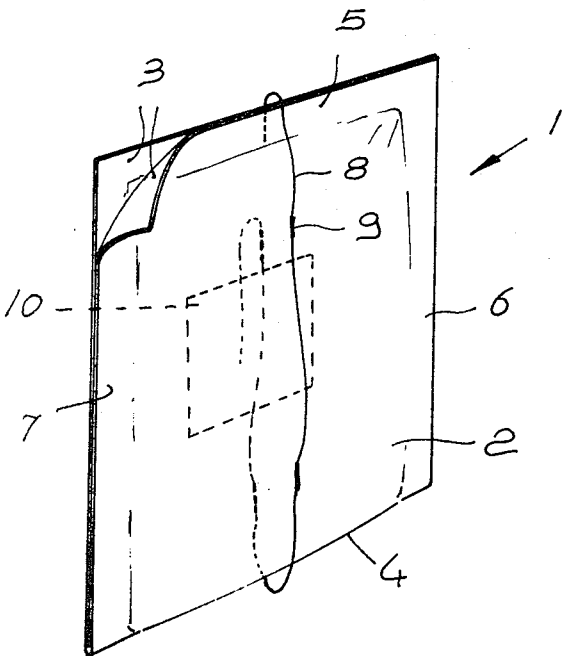
FIG. 1 shows a perspective view of a bag according to the invention.

The bag 1 is formed from a blank of a filter paper 2 coated at one side by a layer 3 of heat-sealable thermoplastic material.

The blank is longitudinally folded along a medial line to form two half sections so that the layers of heat-sealable substance thereof are in contact with each other. Thereafter the sections are sealed together to define a closed space for containing the infusion product. The bag presents a longitudinal folding edge 4, a longitudinal sealing edge 5 and two transversal sealing edges 6 and 7. The thread 8, preferably of cotton, is wound around the bag parallel to the edges 6 and 7 and is fixed with one end to the edge 5 and at opposite faces of the bag in several sealing points 9.

Connected to the other end of the thread 8 is a tag 10, applied thereto by heat-sealing of a portion of heat-sealable sheet material folded in half over the thread. The tag remains thus hanging on one side of the tag.

It will be understood that the fixing of thread is such as to allow an easy detachment at the time the bag is used, without causing the bag to be torn and the contents thereof leaked.

I claim:

1. A method of making a bag for infusion products such as tea which comprises the steps of:

(a) folding a rectangular blank of filter paper coated with a thermoplastic layer in half along a fold line so that two juxtaposed sections of said blank have their thermoplastic layers facing one another;

(b) inserting one end of a natural-fiber string between edges of said sections opposite said fold line and winding said string around said fold line so that said string lies along the filter paper of one of said sections and extends only partly across the filter paper of the other of said sections;

(c) heat sealing the opposite end of said string between layers of a folded tag free from attachment to said sections;

(d) providing an infusion product between said sections and heat sealing said sections together along edges thereof to form a bag and secure said one end to said bag; and (e) at a plurality of locations on each of said sections thermally fusing thermoplastic material of said sections and bonding the thermally fused thermoplastic material through the respective filter paper to said string whereby said string is detachably held to said bag at said locations, a length of said string between said tag and the one of said locations proximal to said opposite end remaining free of attachment to said other of sections whereby said length hangs loosely from the bag.

* * * * *